US006112530A

United States Patent [19]

Tench et al.

[11] Patent Number: 6,112,530

[45] Date of Patent: Sep. 5, 2000

[54] NON-LINEAR THERMAL COUPLING FOR CRYOGENIC COOLERS

[75] Inventors: Orren K. Tench, Wethersfield; K. Michael Yocum, Rocky Hill; Daniel J. Smith, Middlefield, all of Conn.

[73] Assignee: Packard BioScience Company, Meriden, Conn.

[21] Appl. No.: 09/261,704

[22] Filed: Mar. 3, 1999

[51] Int. Cl.[7] ..... F17C 13/00; F25D 3/12

[52] U.S. Cl. ..... 62/50.7

[58] Field of Search ..... 62/50.7, 383, 55.5

[56] References Cited

U.S. PATENT DOCUMENTS

| | | | |
|---|---|---|---|
| 3,717,201 | 2/1973 | Hosmer et al. | 165/96 |
| 4,281,708 | 8/1981 | Wing et al. . | |
| 4,770,004 | 9/1988 | Lagodmos | 62/383 |
| 5,305,612 | 4/1994 | Higham et al. | 62/55.5 |
| 5,394,129 | 2/1995 | Obasih et al. . | |
| 5,737,927 | 4/1998 | Takahashi et al. | 62/51.1 |

*Primary Examiner*—William Doerrler
*Attorney, Agent, or Firm*—John H. Crozier

[57] ABSTRACT

In a preferred embodiment, a non-linear thermal coupling to connect a heat load to a powered cooler, the coupling including: first and second thermal transfer elements, the first transfer thermal transfer element being thermally connected to the heat load and the second thermal transfer element being thermally connected to the powered cooler; the first and second thermal transfer elements being physically separated by a first gap when the first and second thermal transfer elements are at a relatively high temperature, and the first and second thermal transfer elements being in mutual physical contact when the first and second thermal transfer elements are at a relatively low temperature so as to thermally connect the heat load and the powered cooler; and the first and second thermal transfer elements being placed in the mutual physical contact by thermal contraction of a contracting element.

6 Claims, 4 Drawing Sheets

NON-LINEAR THERMAL COUPLING FOR CRYOGENIC COOLERS

BACKGROUND OF THE INVENTION

1. Field of the Invention

The present invention relates generally to electrically powered cryogenic coolers [hereinafter called "cooler(s)"] which are used to cool the contents of vacuum chambers [the contents hereinafter called "object(s)"] to extremely low temperatures, say, on the order roughly of 100 degrees Kelvin or less, and, more particularly, but not by way of limitation, to a novel non-linear coupling for thermally coupling less cold to more cold elements in the cooler.

2. Background Art

Electrically powered coolers are an attractive alternative to a cooler cooled by cryogenic liquids (such as liquid nitrogen) in many applications because they do not require periodic replenishment of the coolant and because there is no evolution of gas in the cooling process.

The efficiency of these electrically powered coolers is relatively low; perhaps a few percent at best. High cooling power thus has serious implications on the size, weight, and power consumption of the cooler. For this and other reasons, the object(s) being cooled are almost always contained in a closed chamber which is evacuated to a low pressure to reduce the heat load. Such a low pressure is known as an "insulating vacuum".

The pressure in such a chamber will rise in time after it is evacuated because of outgassing of all the materials within the chamber and because of gas seepage or leaks past the seals of the chamber. The pressure can be maintained at a low level by various means including continuous or periodic pumping by one or more of various types of vacuum pumps, including mechanical pumps, diffusion pumps, ion pumps, turbo molecular pumps, or cryo pumps. Each of the aforementioned pumps is relatively large and/or expensive, however, compared to the adsorber pump that has historically been used to maintain vacuum in such vacuum chambers. The adsorber pump is simply a quantity of adsorbent, such as activated charcoal or synthetic zeolite, which adsorbs gas molecules when the adsorbent is cooled to cryogenic temperatures. The gas capacity of these adsorbers at cryogenic temperatures is quite large, so they will maintain low pressures for many years under normal conditions. However, if they are allowed to warm up, they will release significant amounts of the gas they have adsorbed, raising the pressure in the chamber to levels above the "insulating vacuum" range. This does not present a problem when cryogenic liquids are used for cooling, as the liquids provide enough cooling power to re-cool the adsorber even when the chamber pressure is high. As the adsorber is cooled, it will re-adsorb the gas and restore the "insulating vacuum" condition in the chamber.

When electrically powered coolers are used, however, they may not have enough power to overcome the heat transferred to the object(s) through the residual gas in the chamber. If the heat load of the object(s) exceeds the cooling power of the cooler, a stall condition is created. In this condition, the temperature does not get low enough for the adsorber to pump properly and the pressure remains at the higher (non-insulting vacuum) level. This stall condition can be corrected only by pumping on the chamber to reduce the pressure.

Accordingly, it is a principal object of the present invention to provide means for enabling electrically powered coolers to cool adsorbers in the presence of a high heat load associated with the higher pressure (non-insulating vacuum) of a warm system.

It is a further object of the invention to provide such means that operates automatically without manual intervention.

It is an additional object of the invention to provide such means that can be economically implemented.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a non-linear thermal coupling to connect a heat load to a powered cooler, said coupling comprising: first and second thermal transfer elements, said first transfer thermal transfer element being thermally connected to said heat load and said second thermal transfer element being thermally connected to said powered cooler; said first and second thermal transfer elements being physically separated by a first gap when said first and second thermal transfer elements are at a relatively high temperature, and said first and second thermal transfer elements being in mutual physical contact when said first and second thermal transfer elements are at a relatively low temperature so as to thermally connect said heat load and said powered cooler; and said first and second thermal transfer elements being placed in said mutual physical contact by thermal contraction of a contracting element.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
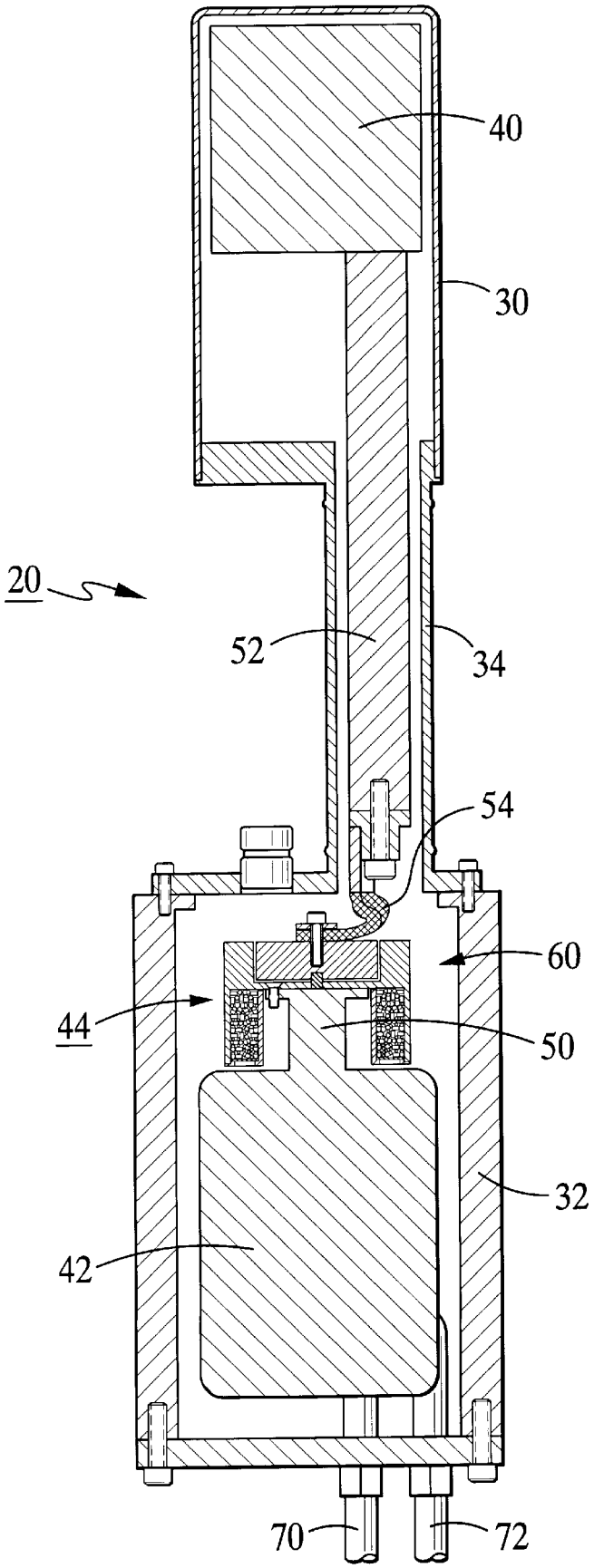
FIG. 1 is a side elevational view, primarily in cross-section, of one embodiment of the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a cryogenic cooler system, generally indicated by the reference numeral 20, and constructed according to one embodiment of the present invention.

The interior of cooler system 20 is sealed from the *=surrounding environment by suitable conventional means and the system includes an upper housing 30 and a lower housing 32, the upper and lower housings being joined by an intermediate housing 34. Upper housing 30 contains an object 40 that is to be cooled, while lower housing 32 contains an electrically powered cooler 42 and a non-linear thermal coupling, the coupling being generally indicated by the reference numeral 44 and constructed according to the present invention. A first cold finger 50 thermally joins electrically powered cooler 42 and coupling 44, while a second cold finger 52 thermally joins object 40 and coupling 44, the lower end of the second cold finger being thermally joined to the coupling by means of a copper braid 54. Braid 54 is provided to decouple object 40 from any vibrations created by electrically powered cooler 42.

Upper housing 30, lower housing 32, and intermediate housing 34 together define a volume 60, or vacuum chamber, that is to be evacuated.

Electrically powered cooler 42 may be any conventional cooler and may be one that operates on a Sterling, a Gifford-McMann, or a Joule-Thompson refrigeration cycle. Refrigerant or electrical lines 70 and 72, sealed to lower housing 32, connect the internal components of electrically powered cooler 42 to external elements (not shown).

Figure 2A:
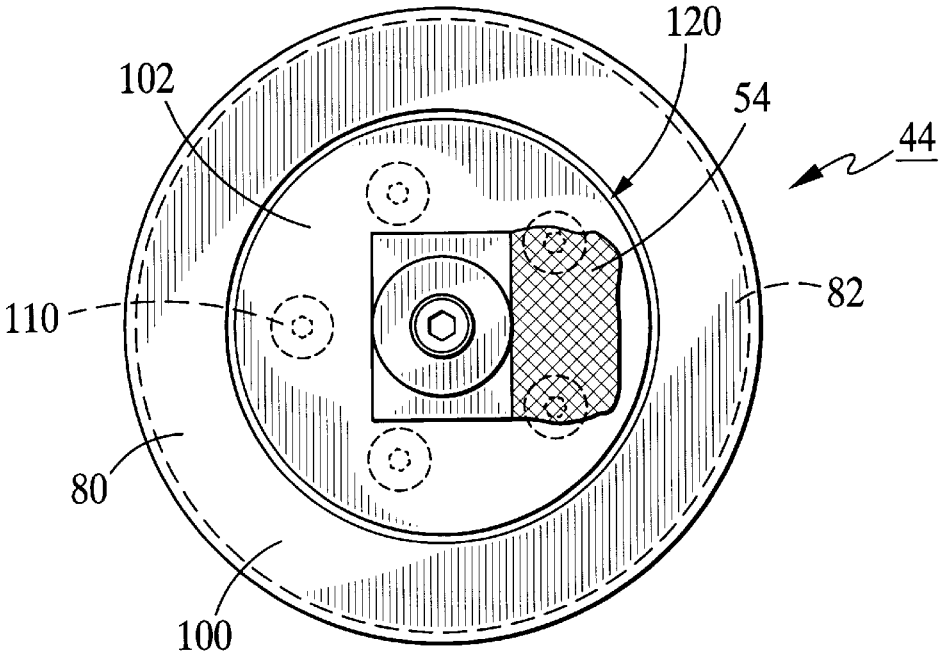
FIG. 2(A) is a top plan view of the non-linear thermal coupling of the embodiment of FIG. 1.
Figure 2B:
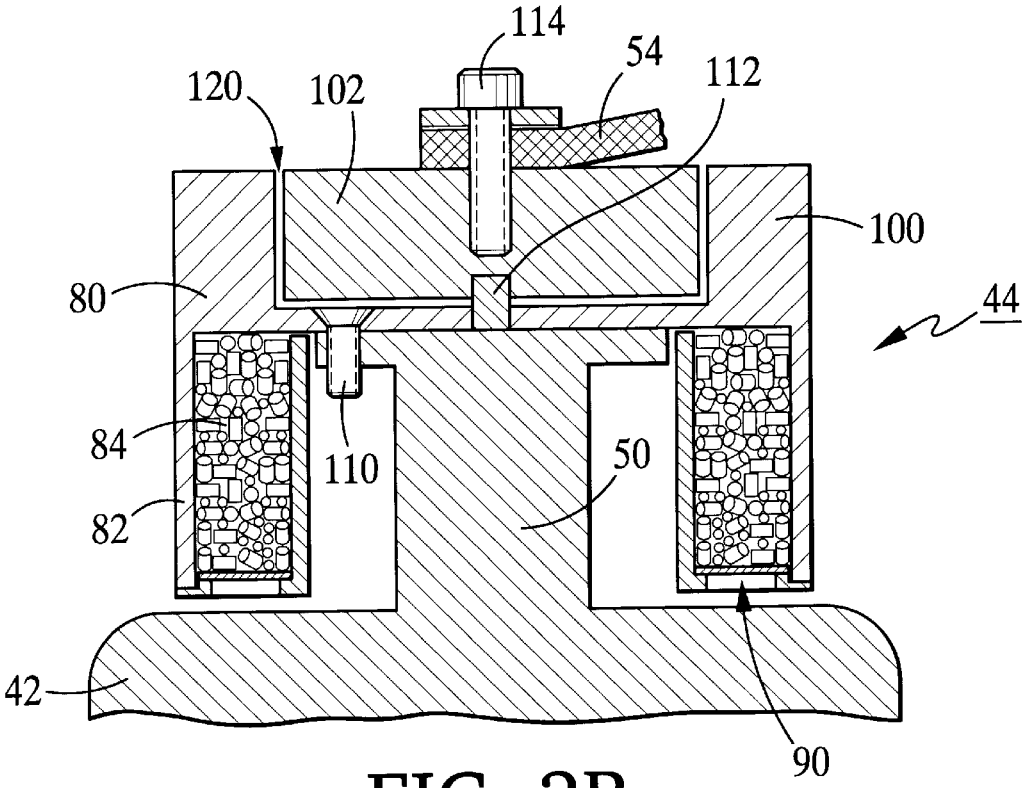
FIG. 2(B) is a side elevational view, in cross-section, of the thermal coupling of FIG. 2(A).

Reference should now be made to FIGS. 2(A) and 2(B) together which illustrate non-linear thermal coupling 44 that includes a cold tip 80 from which depends an annular housing 82 containing an adsorbent material 84, such as the activated charcoal or synthetic zeolite noted above. Housing 82 has one or more opening(s) 90 defined in the bottom thereof for communication between adsorbent material 84 and volume 60 (FIG. 1). Cold tip 80 also includes an annular receptacle 100 defined around the upper portion thereof and disposed within the receptacle is a circular plug 102.

Cold tip 80 is maintained in good thermal contact with first cold finger 50 by means of a plurality of threaded fasteners, as at 110. A locating pin 112 extending between cold tip 80 and plug 102 maintains the cold tip and the plug in proper alignment, and a threaded fastener 114 attaches braid 54 to the plug.

As shown on FIGS. 2(A) and 2(B), receptacle 100 is separated from plug 102 by a gap 120 and, therefore, object 40 (FIG. 1), with its heat load, is essentially thermally isolated from electrically powered cooler 42, save for a very small amount of radiation and convention heat transfer between the receptacle and the plug. This is the condition that prevails when the system is relatively warm. With object 40 thermally isolated from electrically powered cooler 42, the heat load on the electrically powered cooler is much less than it would be if the object were directly connected to the electrically powered cooler. Electrically powered cooler 42 then cools cold tip 80 and adsorbent 84 and the adsorbent pumps down volume 60 (FIG. 1) to a low pressure (insulating vacuum).

As the pressure of volume 60 decreases and cold tip 80 becomes colder, receptacle 100 shrinks, eliminating gap 120, and the receptacle starts to make good thermal contact with plug 102, thus electrically powered cooler begins to extract heat from object 40. As receptacle 100 and plug 102 become colder, the thermal conduction of the coupling increases, so that there is little or no temperature drop across coupling 44 when the ultimate temperature is achieved.

Receptacle 100 is constructed from a material that is a good thermal conductor and has a relatively high thermal coefficient of expansion, such as aluminum, while plug 102 is constructed from a material that is a good thermal conductor and has a relatively low thermal coefficient of expansion, such as copper or beryllium oxide or aluminum oxide.

The mating surfaces of receptacle 100 and plug 102 are smooth to enhance heat transfer.

In summary, non-linear coupling 44 remains "open" and effectively isolates object 40 from electrically powered cooler 42 until the temperature of the coupling is sufficiently low to cause adsorbent 84 to reduce the pressure of volume 60. After the pressure of volume 60 has been thus reduced, and the elements of coupling 44 have been sufficiently cooled, coupling 44 "closes" and causes object 40 to be thermally connected to electrically powered cooler 42 and the electrically powered cooler cools the object to the desired low temperature. The temperature below that which is required to cause cryogenic adsorbers to pump gas effectively is roughly on the order of about 150 degrees Kelvin and it is at roughly that temperature that coupling 44 "closes".

Figure 3:
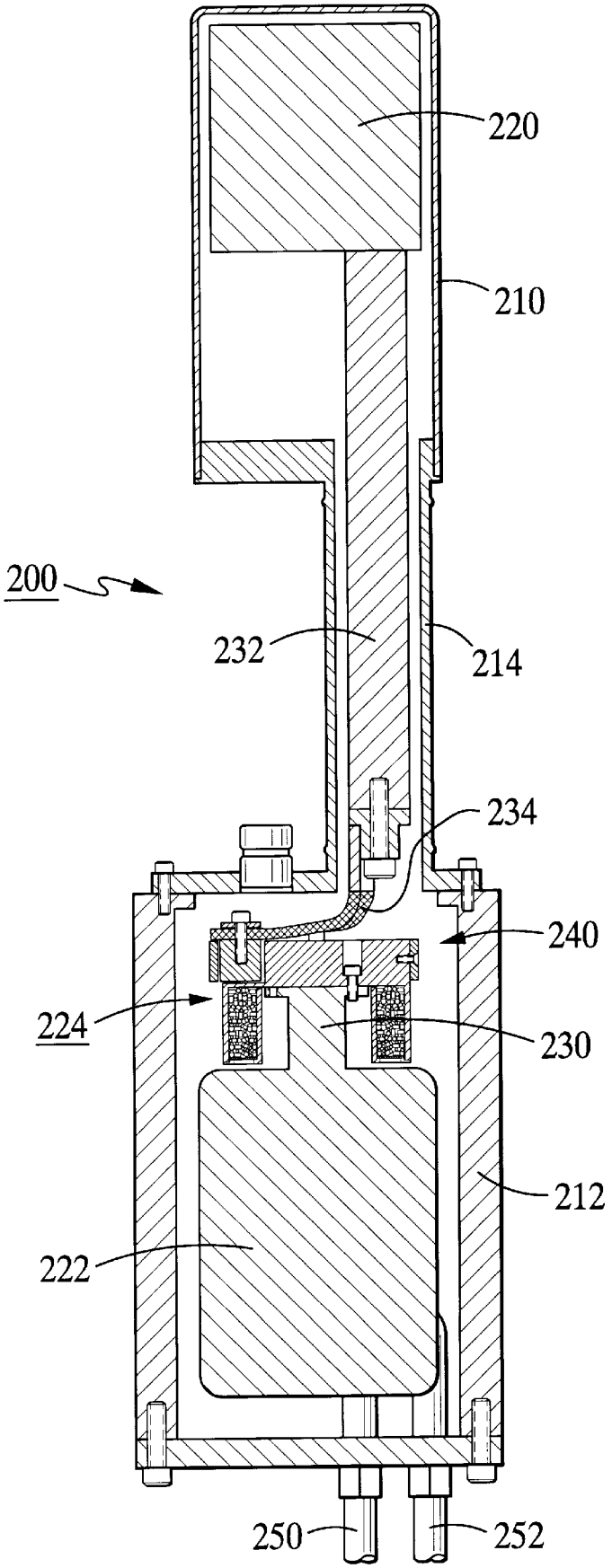
FIG. 3 is a side elevational view, primarily in cross-section, of another embodiment of the present invention.

FIG. 3 illustrates a cryogenic cooler system, generally indicated by the reference numeral 200, and constructed according to another embodiment of the present invention.

The interior of cooler system 200 is sealed from the surrounding environment by suitable conventional means and the cooler system includes an upper housing 210 and a lower housing 212, the upper and lower housings being joined by an intermediate housing 214. Upper housing 210 contains a object 220 that is to be cooled, while lower housing 212 contains an electrically powered cooler 222 and a non-linear thermal coupling, the coupling being generally indicated by the reference numeral 224 and constructed according to the present invention. A first cold finger 230 thermally joins electrically powered cooler 222 and coupling 224, while a second cold finger 232 thermally joins object 220 and coupling 224, the lower end of the second cold finger being thermally joined to the coupling by means of a copper braid 234. Braid 234 is provided to decouple object 220 from any vibrations created by electrically powered cooler 222.

Upper housing 210, lower housing 212, and intermediate housing 214 together define a volume, or vacuum chamber, 240 that is to be evacuated.

Electrically powered cooler 222 may be any conventional cooler and may be one that operates on a Sterling, a Gifford-McMann, or a Joule-Thompson refrigeration cycle. Refrigerant or electrical lines 250 and 252, sealed to lower housing 212, connect connect the internal components of electrically powered cooler 222 to external elements (not shown).

Figure 4A:
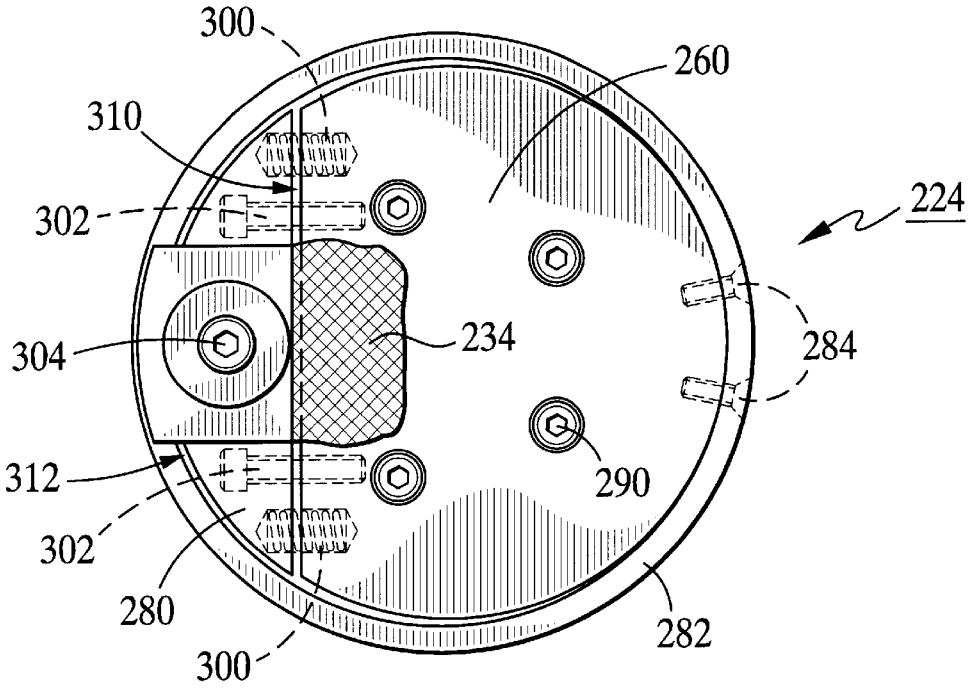
FIG. 4(A) is a top plan view of the non-linear thermal coupling of the embodiment of FIG. 3.
Figure 4B:
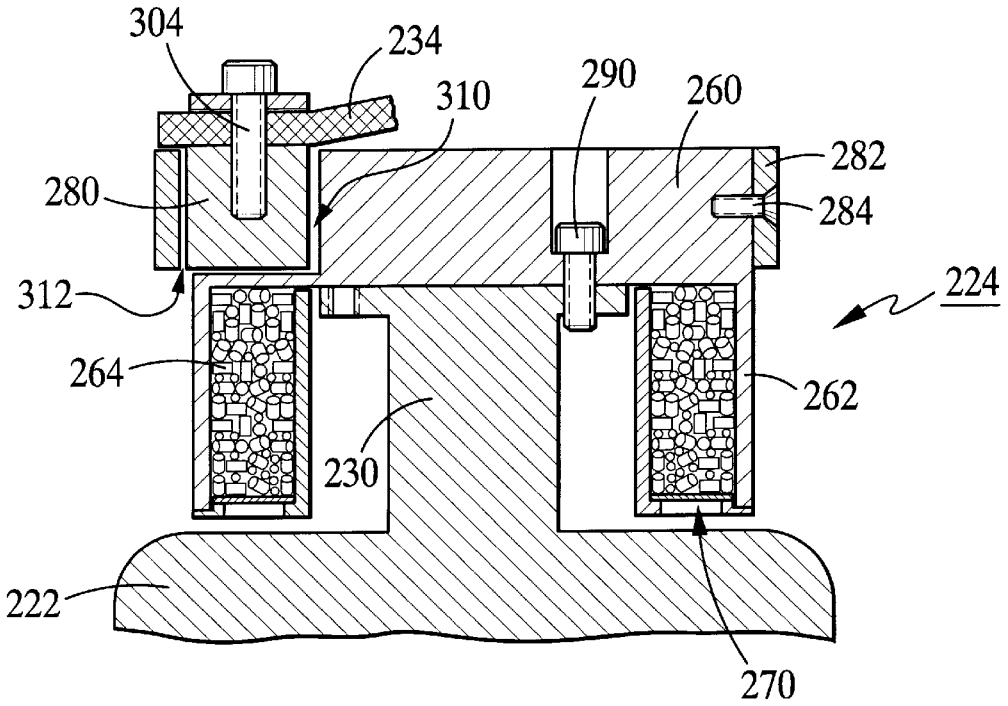
FIG. 4(B) is a side elevational view, in cross-section, of the thermal coupling of FIG. 4(A).

Reference should now be made to FIGS. 4(A) and 4(B) together which illustrate non-linear thermal coupling 224 that includes a cold tip 260 from which depends an annular housing 262 containing an adsorbent material 264, such as the activated charcoal or synthetic zeolite noted above. Housing 262 has one or more opening(s) 270 defined in the bottom thereof for communication between adsorbent material 264 and volume 240 (FIG. 3). A heat sink 280 is disposed adjacent the upper portion of cold tip 260, the outer peripheries of the heat sink and the cold tip being such as to generally define a circle surrounded by a circular band 282 attached to the cold tip by means of two threaded fasteners 284 inserted through the band and into the cold tip.

Cold tip 260 is maintained in good thermal contact with first cold finger 230 by means of a plurality of threaded fasteners, as at 290. Two springs 300 bias apart cold tip 260 and heat sink 280 and two threaded fasteners 302 extend between the cold tip and the heat sink to maintain the cold tip and the heat sink in proper alignment, the shafts of the threaded fasteners being threadedly inserted into the cold tip, but the shafts being loosely disposed in the heat sink. A threaded fastener 304 attaches braid 234 to the heat sink.

As shown on FIGS. 4(A) and 4(B), cold tip 260 is separated from heat sink 280 by a gap 310 and band 282 may be separated from the heat sink by a gap 312, gap 310 being maintained by the engagement of the heads of threaded fasteners 302 with internal surfaces of the heat sink. Therefore, object 220 (FIG. 3), with its heat load, is essentially thermally isolated from electrically powered cooler 222, save for a very small amount of radiation and convention heat transfer between the tip 260 and heat sink 280. This is the condition that prevails when the system is relatively warm. With object 220 thermally isolated from electrically powered cooler 222, the heat load on the electrically powered cooler is much less than it would be if the object were directly connected to the electrically powered cooler. Electrically powered cooler 222 then cools cold tip 260 and adsorbent 264 and the adsorbent pumps down volume 240 (FIG. 3) to a low pressure (insulating vacuum).

As the pressure decreases and cold tip 260 becomes colder, band 282 shrinks, eliminating gaps 310 and 312, and the cold tip makes good thermal contact with heat sink 280; thus electrically powered cooler begins to extract heat from object 260. As cold tip 260, heat sink 280, and band 282 become colder, the band shrinks further, drawing the cold tip and heat sink more firmly together, such that the peripheries thereof form a nearly perfect circle, and the thermal conduction of the coupling increases, so that there is little or no temperature drop across coupling 224 when the ultimate temperature is achieved.

Cold tip 260 and heat sink 280 are constructed from materials that are good thermal conductors. Band 282 is constructed from a material that has a relatively high thermal coefficient of expansion, such as annealed high molecular weight polyethylene. The mating faces of cold tip 260 and heat sink 280 are smooth to enhance heat transfer.

In summary, non-linear coupling 224 remains "open" and effectively isolates object 220 from electrically powered cooler 222 until the temperature of the coupling is sufficiently low to cause adsorbent 264 to reduce the pressure of volume 240. After the pressure of volume 240 has been thus reduced, and the elements of coupling 224 have been sufficiently cooled, coupling 224 "closes" and causes object 220 to be thermally connected to electrically powered cooler 222 and the electrically powered cooler cools the object to the desired low temperature. The temperature below that which is required to cause cryogenic adsorbers to pump gas effectively is roughly on the order of about 150 degrees Kelvin and it is at roughly that temperature that coupling 224 "closes".

With non-linear thermal coupling 224 having a diameter of about 2.75 inches, the segment which is heat sink 280 will have a depth of about 0.75 inch. The thickness of cold tip 260 and heat sink 280 and the width of band 282 will be about 0.5 inch, while the outer band, at room temperature, will have an outer diameter of about 3.00 inch and an inner diameter of about 2.76 inch.

In the embodiments of the present invention described above, it will be recognized that individual elements and/or features thereof are not necessarily limited to a particular embodiment but, where applicable, are interchangeable and can be used in any selected embodiment even though such may not be specifically shown. Terms such as "upper", "lower", "inner", "outer", "inwardly", "outwardly", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A non-linear thermal coupling to connect a heat load to a powered cooler, said coupling comprising:

(a) first and second thermal transfer elements, said first thermal transfer element being thermally connected to said heat load and said second thermal transfer element being thermally connected to said powered cooler;

(b) said first and second thermal transfer elements being physically separated by a first gap when said first and second thermal transfer elements are at a relatively high temperature, and said first and second thermal transfer elements being in mutual physical contact when said first and second thermal transfer elements are at a relatively low temperature so as to thermally connect said heat load and said powered cooler;

(c) said first and second thermal transfer elements being placed in said mutual physical contact by thermal contraction of said second thermal transfer element; and (d) wherein: a portion of said second thermal transfer element encircles said first thermal transfer element and contraction of said portion of said second thermal transfer element, as said first and second thermal transfer elements are cooled, causes said first and second thermal transfer elements to be placed in said mutual physical contact.

2. A non-linear thermal coupling to connect a heat load to a powered cooler, said coupling comprising:

(a) first and second thermal transfer elements, said first thermal transfer element being thermally connected to said heat load and said second thermal transfer element being thermally connected to said powered cooler;

(b) said first and second thermal transfer elements being physically separated by a first gap when said first and second thermal transfer elements are at a relatively high temperature, and said first and second thermal transfer elements being in mutual physical contact when said first and second thermal transfer elements are at a relatively low temperature so as to thermally connect said heat load and said powered cooler;

(c) said first and second thermal transfer elements being placed in said mutual physical contact by thermal contraction of a contracting element; and (d) wherein: said contracting element comprises a band encircling said first and second thermal transfer elements and, as said first and second thermal transfer elements and said contracting element are cooled, contraction of said band causes said first and second thermal transfer elements to be placed in said mutual physical contact.

3. A non-linear thermal coupling, as defined in claim 2, wherein: a second gap exists between said band and said first thermal transfer element when said first and second thermal transfer elements are not in said mutual physical contact.

4. A cryogenic cooler system, comprising:

(a) a housing;

(b) an object, having a heat load, disposed in said housing;

(c) powered cooler means disposed in said housing;

(d) a gas adsorber disposed in said housing and in intimate thermal contact with said powered cooler means;

(e) a non-linear thermal coupling having first and second thermal transfer elements, said first transfer thermal transfer element being thermally connected to said heat load and said second thermal transfer element being thermally connected to said powered cooler means and said gas adsorber;

(f) said first and second thermal transfer elements being physically separated by a first gap to permit said gas adsorber to be cooled and allowed to pump residual gas in said housing, with said heat load being thermally disconnected from said powered cooler means by said first and second thermal transfer elements being physically separated, when said first and second thermal transfer elements are at a temperature above that which is required to cause cryogenic adsorbers to pump gas effectively;

(g) said first and second thermal transfer elements being in mutual physical contact to thermally connected said object to said powered cooler means when said first and second thermal transfer elements are at a temperature below that which is required to cause cryogenic adsorbers to pump gas effectively;

(h) said first and second thermal transfer elements being placed in said mutual physical contact by thermal contraction of said second thermal heat transfer element; and (i) a portion of said second thermal transfer element encircles said first thermal transfer element and contraction of said portion of said second thermal transfer element as said first and second thermal transfer elements are cooled causes said first and second thermal transfer elements to be placed in said mutual physical contact.

5. A cryogenic cooler system, comprising:

(a) a housing;

(b) an object, having a heat load, disposed in said housing;

(c) powered cooler means disposed in said housing;

(d) a gas adsorber disposed in said housing and in intimate thermal contact with said powered cooler means;

(e) a non-linear thermal coupling having first and second thermal transfer elements, said first transfer thermal transfer element being thermally connected to said heat load and said second thermal transfer element being thermally connected to said powered cooler means and said gas adsorber;

(f) said first and second thermal transfer elements being physically separated by a first gap to permit said gas adsorber to be cooled and allowed to pump residual gas in said housing, with said heat load being thermally disconnected from said powered cooler means by said first and second thermal transfer elements being physically separated, when said first and second thermal transfer elements are at a temperature above that which is required to cause cryogenic adsorbers to pump gas effectively;

(g) said first and second thermal transfer elements being in mutual physical contact to thermally connected said object to said powered cooler means when said first and second thermal transfer elements are at a temperature below that which is required to cause cryogenic adsorbers to pump gas effectively;

(h) said first and second thermal transfer elements being placed in said mutual physical contact by thermal contraction of a contracting element; and (i) wherein: said contracting element comprises a band encircling said first and second thermal transfer elements and, as said first and second thermal transfer elements and said contracting element are cooled, contraction of said band causes said first and second thermal transfer elements to be placed in said mutual physical contact.

6. A cryogenic cooler system, as defined in claim 5, wherein: a second gap exists between said band and said first thermal transfer element when said first and second thermal transfer elements are not in said mutual physical contact.

* * * * *